United States Patent [19]

Sohn

[11] Patent Number: 4,490,844

[45] Date of Patent: Dec. 25, 1984

[54] LOW FREQUENCY TRANSFORMER

[76] Inventor: Tong-Hoon Sohn, K.P.O. Box 1512, Seoul, Rep. of Korea

[21] Appl. No.: 483,506

[22] Filed: Apr. 11, 1983

[30] Foreign Application Priority Data

Apr. 10, 1982 [KR] Rep. of Korea ..... 82-1582

[51] Int. Cl.[3] ..... H01F 27/28

[52] U.S. Cl. ..... 381/104; 330/171; 330/190; 330/197; 336/170

[58] Field of Search ..... 336/170; 330/165, 166, 330/167, 168, 169, 170, 171, 188, 189, 190, 195, 196, 197; 381/104

*Primary Examiner*—Gene Z. Rubinson
*Assistant Examiner*—James L. Dwyer
*Attorney, Agent, or Firm*—Brumbaugh, Graves, Donohue & Raymond

[57] ABSTRACT

A low frequency transformer for an audio system has a core, a primary winding, a secondary winding, insulation between the primary and secondary windings, a tertiary winding, and insulation between the secondary and tertiary windings. One end of the tertiary winding is embedded in the insulation between the secondary and tertiary windings, and the other end is grounded. With a tertiary winding arranged and connected in this fashion, the effects of external interference signals are substantially eliminated, and the output of the transformer is improved, i.e., it has less waveshape and frequency distortion. Preferably, the primary and tertiary windings are wound around the core in the same direction while the secondary winding is wound around the core in the opposite direction.

11 Claims, 3 Drawing Figures

LOW FREQUENCY TRANSFORMER

BACKGROUND OF THE INVENTION

The invention relates to a low frequency transformer for an audio system and a method of making it. More particularly, the invention concerns a low frequency transformer having primary, secondary, and tertiary windings with insulation between each winding wherein one end of the tertiary winding is embedded in the insulation between the secondary winding and the tertiary winding, and the other end is grounded.

In a conventional audio system, a volume adjusting variable resistor, which is located next to a detection circuit, adjusts the volume of the sound. In order to increase the sensitivity, a high frequency transformer has been used; however, the efficiency of a high frequency transformer in the low frequency range is remarkably reduced. That is well-known fact. In order to improve the efficiency, the output voltage fluctuation of the conventional transformer is controlled by adjusting the relative distance of two magnetic iron cores lined up on a line, whose relative distance affects the amount of magnetic flux coupling the magnetic iron cores together. This type of control of the output voltage fluctuation is practically too big.

Also, in a conventional audio system, if the transformer is operating in an overloaded condition, i.e., the output of the transformer is more than the rated load of the transformer, the output signal of the transformer is distorted, in other words, audio waveshape distortion results. Furthermore, if multistage speakers are connected in parallel to the output of the transformer, a common arrangement, the output frequency of the transformer may be different than the input frequency, i.e., frequency distortion may occur.

The performance of multistage speakers connected in parallel may be improved by increasing the current in the secondary winding, i.e., by increasing the output current of the transformer. But even if this technique is used, waveshape distortion, which may occur because of a transformer overload, and/or noise, which may be caused by external interference signals or leakage current from the primary winding, could result.

In commonly known audio systems, typical impedance values for speakers, which are known as passive speakers, are 4, 8, 16, and 600 ohms. Matching the input impedance of the speakers with the output impedance of the output amplifier of the audio system is difficult. Additionally, if the output power of the amplifier does not meet the rated power of the speaker, the speaker is unusable in the higher range of its capacity.

SUMMARY OF THE INVENTION

The invention is a low frequency transformer for an audio system and a method for making it. A low frequency transformer in accordance with the invention has a primary winding wound around a core, a first layer of insulation over the primary winding, a secondary winding wound around this insulation, a second layer of insulation over the secondary winding, and a tertiary winding wound around the second layer of insulation. One end of the tertiary winding is embedded in the second layer of insulation, i.e., between the secondary winding and the tertiary winding, and the other end of the tertiary winding is connected to ground. With the tertiary winding arranged in this way, the effects of external interference signals and leakage currents on the transformer are substantially eliminated. Accordingly, the output of the transformer is freer of frequency and waveshape distortion.

Preferably, the primary winding and the tertiary winding are wound around the core in one direction, e.g., clockwise, and the secondary winding is wound around the core in the opposite direction, e.g., counterclockwise. The primary winding should be longer, that is, there should be more turns, and have a smaller diameter, in other words, the diameter of the wire used should be smaller, than the secondary winding; the tertiary winding should be longer and have a smaller diameter than the primary winding. Such a transformer advantageously has a primary winding with an impedance between 100 and 800 ohms, a secondary winding with an impedance between 0.1 and 10 ohms, and a tertiary winding with an impedance which is effectively infinite compared to the impedances of the primary and secondary windings.

It is an object of the invention to provide a low frequency transformer in which the effects of external interference signals are substantially eliminated and which allows multistage speakers to be connected in parallel without waveshape or frequency distortion of the output signal. It is another object of the invention to provide a transformer that permits impedances to be matched easily and that allows an output audio amplifier to operate at the rated power of the speaker. The above and further advantages of the invention will be better understood with reference to the following detailed description of the preferred embodiments taken in conjunction with the attached drawings.

DETAILED DESCRIPTION OF THE PREFERRED EMBODIMENTS

Figure 1:
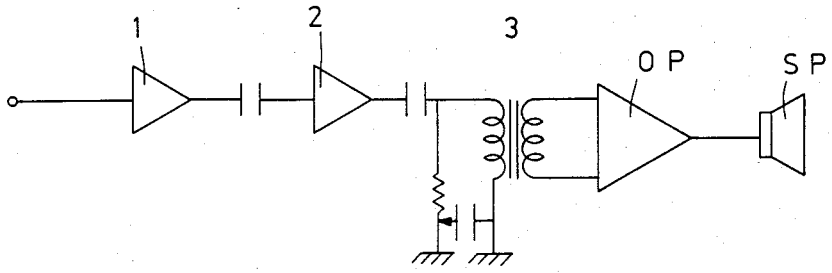
FIG.1 PRIOR ART
FIG. 1 is a schematic block diagram of a conventional audio circuit.

FIG. 1 illustrates a conventional system in which a detection circuit 1 for an audio system is connected to a volume-adjusting circuit 2. The output of the volume adjusting circuit 2 is connected to the input of a conventional transformer circuit 3, and the output of the transformer circuit is connected to an output amplifier OP, which drives a speaker SP.

Figure 2:
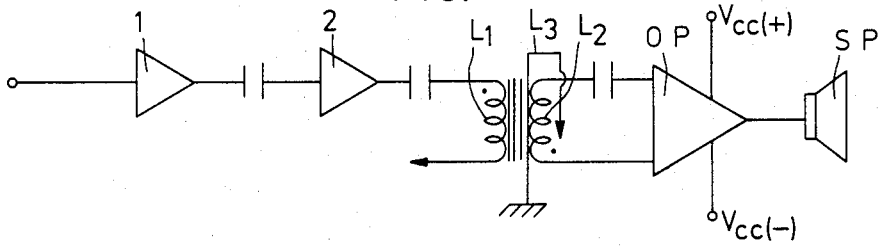
FIG. 2 is a schematic block diagram of an audio circuit having a low frequency transformer in accordance with the invention.

In FIG. 2, wherein like reference numerals designate like components, a low frequency transformer in accordance with the invention is used in the audio system instead of a conventional transformer. The transformer has three windings: a primary winding $L_1$, a secondary winding $L_2$, and a tertiary winding $L_3$. The primary winding $L_1$ is connected to the volume control circuit, and the secondary winding $L_2$ is connected to the output amplifier OP. One end of the tertiary winding $L_3$ is grounded, and the other end is set in a second layer of insulation between the secondary winding and the tertiary winding, as will be discussed in more detail below.

Figure 3:
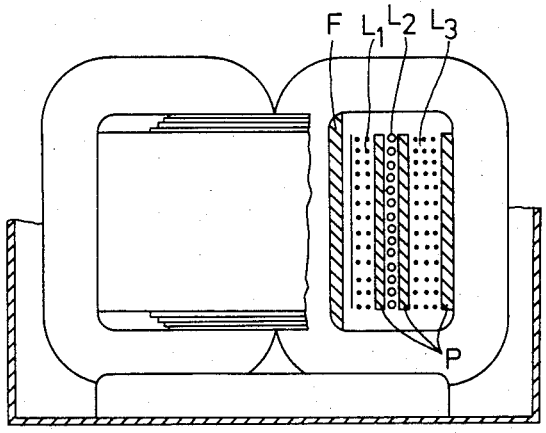
FIG. 3 is a side elevational view with parts broken away for illustration of a low frequency transformer in accordance with the invention.

FIG. 3 better illustrates the construction of a transformer in accordance with the invention. The primary winding $L_1$ is wound in a clockwise direction around the magnetic core F of the transformer, as in a conventional transformer. A first layer of insulation sheets P are then provided over the primary winding. The secondary winding $L_2$ is wound in a counterclockwise direction around the first layer of insulation sheets. A second layer of insulation sheets P are provided over the secondary winding. Finally, the tertiary winding $L_3$ is wound in a clockwise direction around the second layer of insulation sheets. The tertiary winding is wound so that one end is embedded in the second layer of insulation sheets and the other end is capable of being connected to ground. A third insulation layer P may be provided on the outside of the tertiary winding.

The core of a conventional transformer used in an audio system is typically connected to ground. By contrast, in an audio system using a low frequency transformer in accordance with the invention, one end of the tertiary winding is grounded and the other is embedded in the insulation of the transformer. With this arrangement, audio waveshape distortion and frequency distortion caused by external interference signals and leakage currents are eliminated, which has been experimentally verified.

The ratio of the number of turns in the primary winding to the number of turns in the secondary winding should be between 100 to 1 and 800 to 1. Practically, the impedance of the primary winding should be between 100 and 800 ohms, and preferably it should be between 100 and 500 ohms. Similarly, the impedance of the secondary winding should practically be between 0.1 and 10 ohms and preferably between 0.5 and 4 ohms. The impedance of the tertiary winding should effectively be infinite compared to the impedances of the other two windings; such an impedance may be obtained by using a long wire with a small diameter, e.g., with a diameter of less than 0.08 millimeter.

Although the invention has been described herein with respect to specific embodiments thereof, it will be understood that various modifications and variations may be made thereto without departing from the inventive concepts disclosed. All such variations and modifications are intended to be included within the spirit and scope of the appended claims.

I claim:

1. A low frequency transformer comprising:
- a core;
- a primary winding wound around said core;
- a secondary winding wound around said core;
- first insulating means for insulating said primary winding from said secondary winding;
- a tertiary winding wound around said core having a first end adapted for connection to ground; and
- second insulating means for insulating said secondary winding from said tertiary winding with a second end of said tertiary winding embedded therein.

2. The low frequency transformer of claim 1 wherein said primary winding is longer and has a smaller diameter than said secondary winding and wherein said tertiary winding is longer and has a smaller diameter than said primary winding.

3. The low frequency transformer of claim 1 wherein said primary winding and tertiary winding are wound around said core in a same first direction and wherein said secondary winding is wound around said core in a second direction opposite said first direction.

4. The low frequency transformer of claim 3 wherein said primary winding and said tertiary winding are wound in a clockwise direction around said core and wherein said secondary winding is wound in a counterclockwise direction around said core.

5. The low frequency transformer of claim 1 wherein said primary winding has an impedance between 100 and 800 ohms, said secondary winding has an impedance between 0.1 and 10 ohms, and said tertiary winding has an impedance that is effectively infinite compared to the impedances of said primary winding and said secondary winding.

6. The low frequency transformer of claim 1 wherein said primary winding is connected to a volume control circuit and said secondary winding is connected to an amplifier circuit.

7. A method for making a low frequency transformer comprising the steps of:
- winding a primary winding around a core;
- providing first insulating means for insulating said primary winding from a secondary winding;
- winding said secondary winding around said first insulating means;
- providing second insulating means for insulating said secondary winding from a tertiary winding;
- embedding a first end of said tertiary winding in said second insulating means; and
- winding said tertiary winding around said second insulating in such a manner so that a second end of said tertiary winding is capable of being connected to ground.

8. The method of claim 7 wherein the step of winding a primary winding includes winding a primary winding that is longer and has a smaller diameter than said secondary winding and wherein the step of winding said tertiary winding includes winding a tertiary winding that is longer and has a smaller diameter than said primary winding.

9. The method of claim 7 wherein the step of winding a primary winding and the step of winding said tertiary winding are performed by winding said windings in a same first direction and wherein the step of winding said secondary winding is performed by winding said secondary winding in a second direction opposite said first direction.

10. The method of claim 9 wherein said primary winding and said tertiary winding are wound in a clockwise direction and wherein said secondary winding is wound in a counterclockwise direction.

11. The method of claim 7 wherein the step of winding a primary winding includes winding a primary winding having an impedance between 100 and 800 ohms, wherein the step of winding said secondary winding includes winding a secondary winding having an impedance between 0.1 and 10 ohms, and wherein the step of winding said tertiary winding includes winding a tertiary winding having an impedance that is effectively infinite compared to the impedances of said primary winding and said secondary winding.

* * * * *